US005722907A

United States Patent [19]

Paulun

[11] Patent Number: 5,722,907

[45] Date of Patent: Mar. 3, 1998

[54] BAT AND BALL GAME

[76] Inventor: Carl L. Paulun, 620 Third St., NE., New Philadelphia, Ohio 44663

[21] Appl. No.: 726,769

[22] Filed: Oct. 7, 1996

[51] Int. Cl.[6] ..... A63B 71/02

[52] U.S. Cl. ..... 473/474; 473/473; 473/465

[58] Field of Search ..... 473/471, 474, 473/462, 465, 470, 473, 415

[56] References Cited

U.S. PATENT DOCUMENTS

| | | | |
|---|---|---|---|
| 1,712,159 | 5/1929 | O'Donnell . | |
| 2,545,615 | 3/1951 | Hatley | 273/105 |
| 2,812,946 | 11/1957 | Hughes | 473/465 |
| 3,024,024 | 3/1962 | Chalcroft | 273/1 |
| 3,554,551 | 1/1971 | Apiki | 273/95 |
| 3,841,634 | 10/1974 | Mavrofrides | 473/474 |
| 3,994,497 | 11/1976 | Cordingley | 473/470 |
| 4,045,022 | 8/1977 | Grant et al. | 473/474 |
| 4,373,734 | 2/1983 | Frank | 473/471 |
| 4,758,002 | 7/1988 | Murphy | 273/411 |
| 4,781,385 | 11/1988 | Harley | 273/411 |
| 5,207,433 | 5/1993 | Moore | 273/411 |
| 5,211,394 | 5/1993 | Jackson et al. | 273/25 |
| 5,562,289 | 10/1996 | McAllister | 473/468 |

*Primary Examiner*—Mark S. Graham
*Attorney, Agent, or Firm*—Sand & Sebolt

[57] ABSTRACT

The invention is a novel athletic filed and outdoor game played thereon. The game uses bats, mitts, and a ball on a rectangular playing field where each team attempts to score points by hitting the ball into the other team's end zone. Specifically, the defensive team pitches to the offensive team whereby the present hitter for the offensive team swings at the pitch and in some cases hits the ball. When the ball is hit it either may either be hit into fair or foul territory. When hit into foul territory, the ball is out play, or alternatively the defensive team attempts to catch the ball so as to force the movement of home plate to a point adjacent the catch which is back toward the hitting team's goal line. In contrast, when the ball is hit into fair territory, the defensive team uses bats to attempt to reverse the direction of the moving ball and hit it over the offensive team's goal line. Whenever the ball crosses a goal line, points are scored by the other team.

10 Claims, 19 Drawing Sheets

BAT AND BALL GAME

BACKGROUND OF THE INVENTION

1. Technical Field

The invention is generally directed to outdoor summer sports games. More particularly, the invention relates to field games and to methods of playing field games using bats, mitts, and a ball. Specifically, the invention relates to games and methods of playing games where the home plate is portable and advances or retreats along a center line based upon the performance of the present hitter.

2. Background Information

Numerous outdoor summer sports using balls and bats are well known including baseball and cricket. In addition, numerous outdoor sports are well known using grass or artificial turf covered athletic fields including football, baseball, cricket, and soccer. The games of baseball and football are extremely popular and the rules and strategies are well known in the art today. Below is a general discussion of these two popular sports.

In general, baseball involves two opposing teams playing nine innings of baseball where in each inning each team plays offense, or bats, while the other team plays defense, or fields, until the team at bat makes three outs, and then vice-versa.

The field is a quarter-circular grass or artificial turf covered area with two linear foul lines and a curved fence defining the periphery. The field as shown in FIG. 1 is divided into an infield area that includes a dirt base path and an outfield area. The four corners of the dirt base path are defined by four bases or plates referred to as first base, second base, third base, and home plate, the cumulation of which define a square with ninety feet apart sides. A raised pitching mound is approximately centered within the infield directly in line with home plate and second base and sixty feet and six inches away from home plate. A pitching rubber is positioned at the top of the mound.

The defensive team generally positions one player on the pitching mound, one behind home plate, one each by first and third base, one each to the right and left of second base, and three in the outfield. Alternatively, in a version referred to as softball, a tenth player is used as a fourth outfielder.

The overall goal in baseball is to offensively score runs by getting hits or walks, while defensively prohibiting the other team from scoring runs by getting hits or walks. The way to prohibit the other team from scoring runs is to get its hitters and runners out.

Outs are made in four principal ways although numerous nuances to this also exist. First, outs are made by getting three strikes called or swinging unsuccessfully at three pitches or any combination of these. Second, outs are made by hitting a ball that the other team catches. Third, outs are made by not reaching a subsequent base prior to a throw of a ball picked up after a hit. Fourth, outs are made by being caught off of a base by a fielder holding the ball.

The teams in baseball score runs by having a runner cross home plate sequentially after crossing first, second, and third. Runners get on base either by getting a hit, walking, being hit by a pitch, or by error of a fielder. A hit may be a single, double, triple, or home run based upon the number of bases the hitter is able to advance to.

Another popular sport that uses a ball and is played by two teams on a field is American football. Specifically, football involves two opposing teams playing four quarters where each team plays offense until it either scores, turns the ball over, punts, or fails to achieve a first down in four plays, while the other team plays defense to prevent the offensive team from advancing the ball and ultimately scoring, and then vice-versa until all four of the fifteen minute quarters have expired.

The field as is shown in FIG. 2 is a rectangular grass or artificial turf covered area with two linear foul lines and two linear end lines perpendicular to the foul lines defining the rectangular periphery. Ten yards in from each end line is a goal line parallel to the end line defining an end zone in between the respective end and goal lines. The area in between the goal lines is the playing field which is one hundred yards long and generally divided into ten yard zones each of which is divided in half and also includes hash marks for each yard therebetween.

The game begins with a kick off by one eleven man team to the other eleven man team. The ball is received by one player who advances the ball until tackled. At this point, the offensive team has a first down with ten yards to go. The offensive team then runs a play of either a running or passing type in an attempt to advance the ball from that point to a new point where the ball handler or receiver is tackled or pushed out of bounds. If ten yards is achieved either in one or more plays, but no more than four plays, then a first down is achieved and the offensive team gets another first and ten. If for instance, only five yards was achieved on first down, then it is second down and five yards to go. In addition, the offensive team could lose yardage.

Six points are scored for a touchdown which involves advancing the ball by running or catching over the opposing team's goal line and into the end zone. After a touchdown, the scoring team then has an opportunity to score one more point by kicking the ball through a goal post from the two or three yard line, or to score two points by again advancing the ball into the end zone by a run or pass from the two or three yard line. Other points are scored by kicking a field goal (three points) when on offense, or by tackling the ball carrier in his own end zone (two points).

The popularity of baseball and football has increased steadily in popularity over the years such that these are two of the most popular sports in the, U.S. today. It is therefore desirous to invent a new sport that encompasses some, of the better features of each.

SUMMARY OF THE INVENTION

Objectives of the invention include providing a new outdoor summer activity.

Another object of this invention is to provide a new outdoor summer activity using regulation baseballs, bats and fielder's gloves and mitts.

Yet another object of this invention is to provide a new outdoor summer activity playable on an open field of generally rectangular or square shape.

Yet another objective is to provide an outdoor game played on an open field with a standard bat, ball and fielding mitts.

A still further object of the invention is to provide a game which is of simple construction, which achieves the stated objectives in a simple, effective and inexpensive manner, and which satisfies needs existing in the art.

These and other objectives of the invention are obtained by the improved game apparatus comprising an athletic field having a pair of opposing end lines separated by a pair of opposing side lines defining the field therebetween, the field further including a goal line parallel to and spaced apart from each of the end lines thereby defining an end zone between each goal line and end line, the field further including a plurality of zones; and a plurality of base lines parallel to and spaced apart between the goal lines and a center line parallel to and spaced apart between the side lines, the plurality of base lines and the center line defining the plurality of zones.

These and other objectives are also obtained by the improved method of playing a game using at least one bat, and at least one ball, including the step of defining a playing surface as a rectangular-shaped field having a pair of opposing end lines separated by a pair of opposing side lines defining the field therebetween, the field further including a goal line parallel to and spaced apart from each of the end lines thereby defining an end zone between each goal line and end line, the field further including a plurality of zones as defined by a plurality of base lines parallel to and spaced apart between the goal lines and a center line parallel to and spaced apart between the side lines; pitching a baseball from a pitching rubber positioned along the center line toward a place spaced apart a constant distance from the pitching rubber along the center line; and selectively swinging at the baseball when in the proximity of the plate by a hitter adjacent the plate.

BRIEF DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENT

Figure 1:
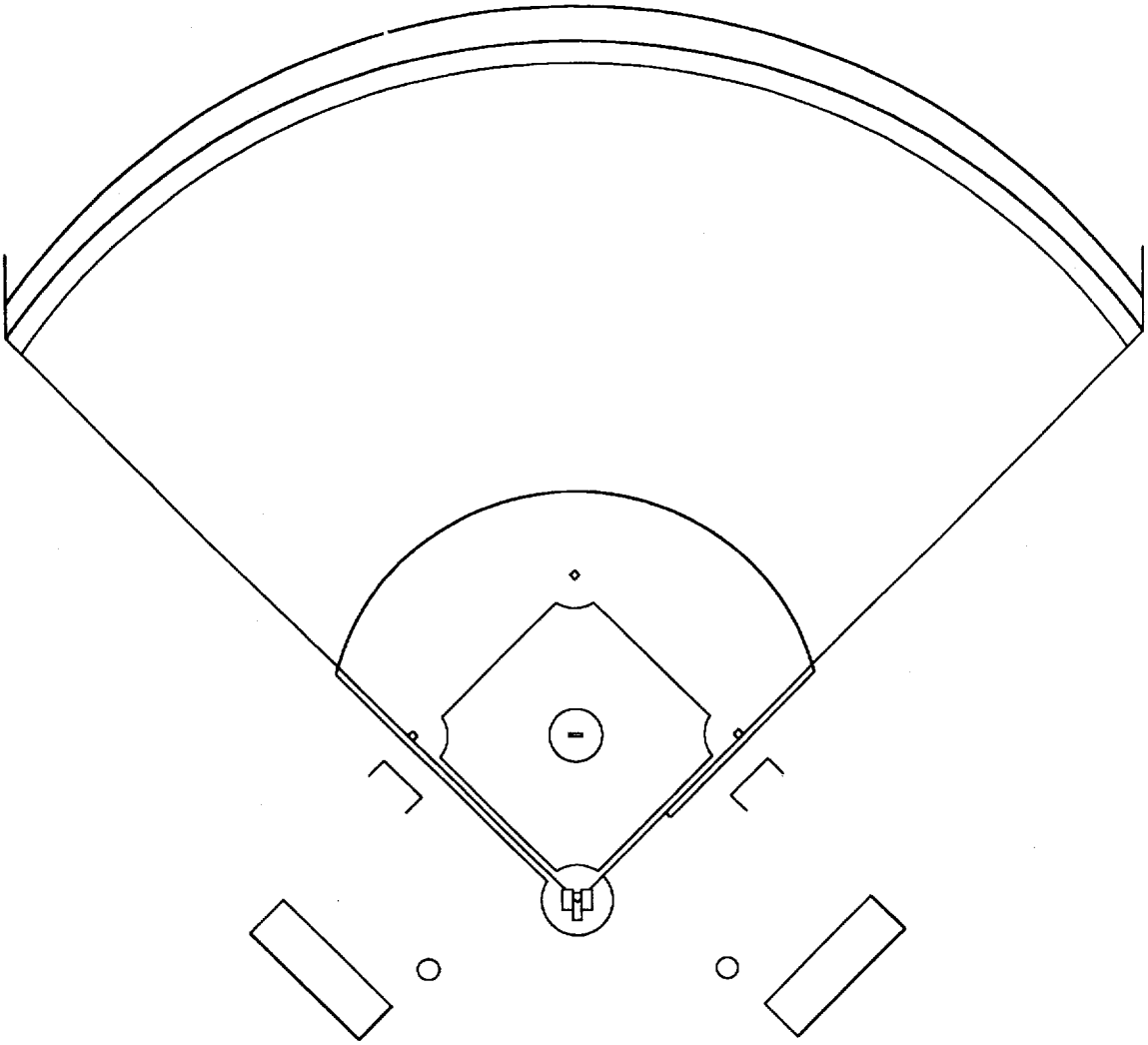
FIG-1 PRIOR ART
FIG. 1 is a plan view of a prior art baseball field.
Figure 2:
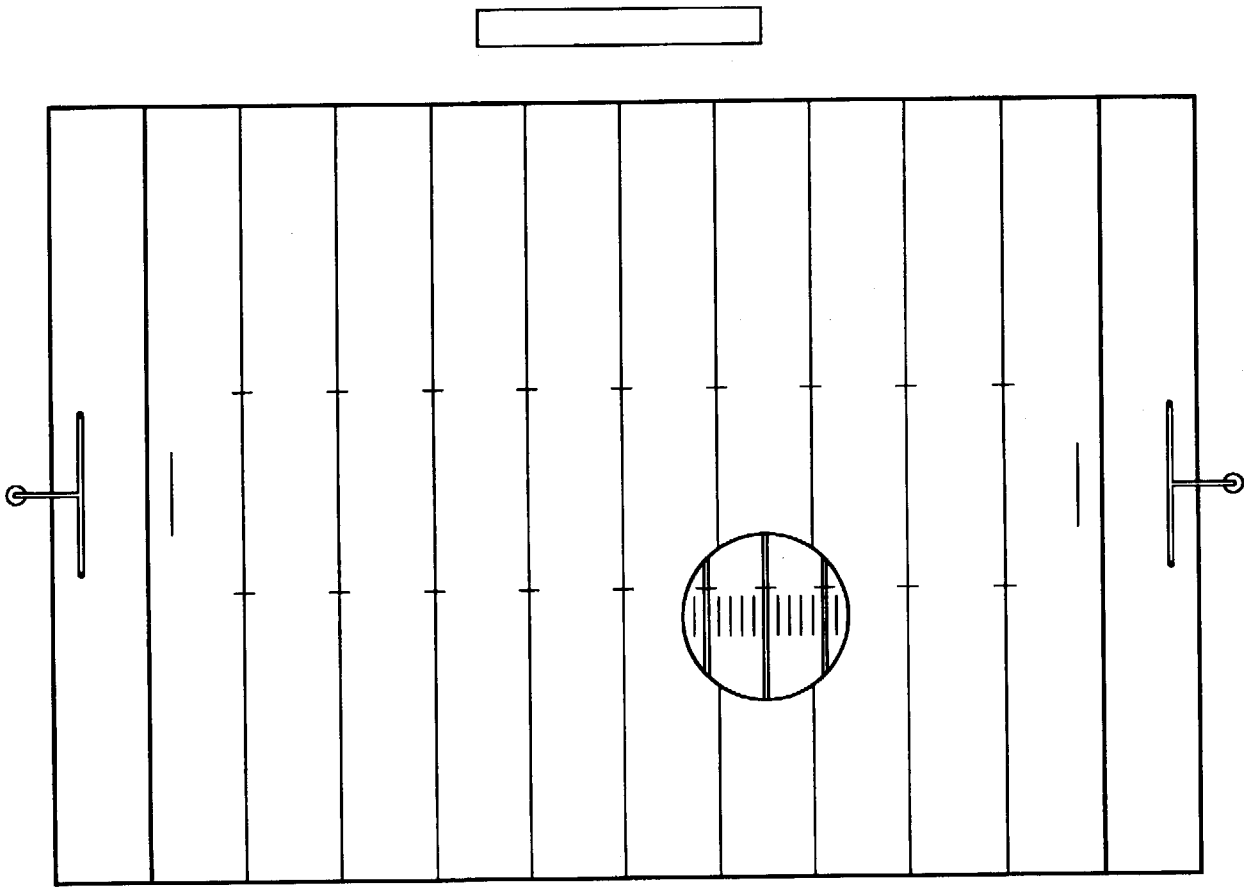
FIG-2 PRIOR ART
FIG. 2 is a plan view of a prior art football field.

Referring now to the drawings, the overall arrangement of the preferred equipment and method of playing a new outdoor summer sport and field involving both teams using bats to offensively and defensively advance a baseball is shown. This new sport uses a unique field arrangement, and novel rules and goals in unison with regulation baseball equipment.

Figure 3:
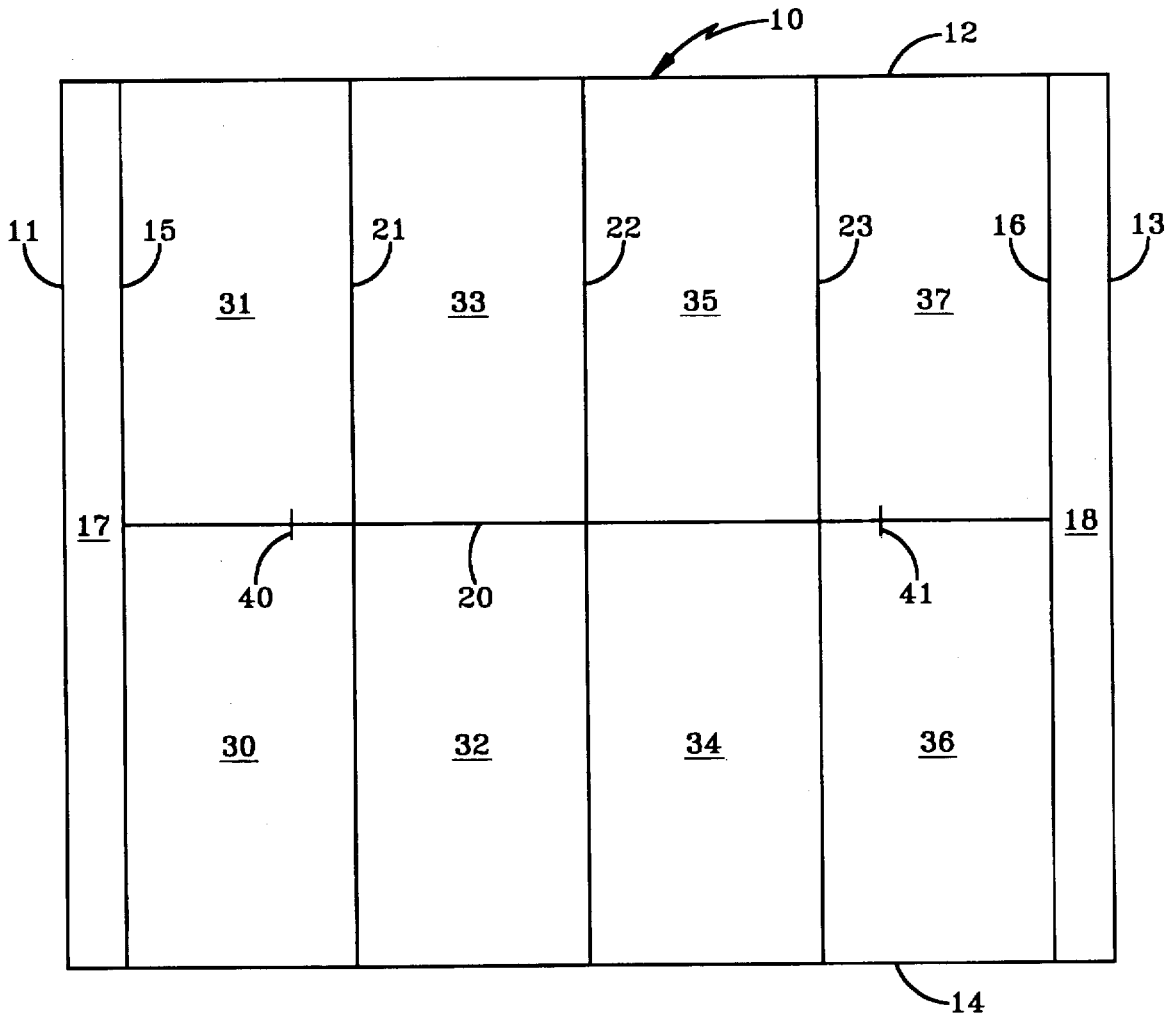
FIG. 3 is a plan view of the field used in the present invention.

The game of the present invention is played on a field 10 as is shown generally in FIG. 3. Field 10 has foursides 11, 12, 13, and 14 and is in a generally square or rectangular shape. Opposing sides 11 and 13 are end lines, while the other opposing sides 12 and 14 are side lines which are out of bounds or out of play lines. A goal line 15 and 16 runs parallel to each of the end lines 11 and 13, respectively, thereby defining an end zone 17 and 18 at each end respectively. The goal lines are preferably three hundred and sixty (360) feet apart and the field is preferably three hundred (300) feet wide, although there is no criticality to these dimensions and numerous other dimensions are well within the scope of the present invention.

Field 10 is divided into sections or zones. Specifically, a center line 20 extending perpendicular to and between goal lines 15 and 16 divides the field of play into two halves. Additionally, three base lines 21, 22, and 23 parallel to end lines 11 and 13 further divide the field of play. These three base lines are the first, second and third base lines, or third, second, and first base lines, respectively, depending upon which direction the offensive or hitting team is facing. These three baselines 21–23 result, in combination with the center line 20, in division of the field into eight sections or zones 30, 31, 32, 33, 34, 35, 36, and 37 each of which is covered defensively by a fielder as described below. The zones are referred to as first right and left fields 30 and 31, respectively, second right and left fields 32 and 33, respectively, third right and left fields 34 and 35, respectively, and fourth right and left fields 36 and 37, respectively.

Figure 4:
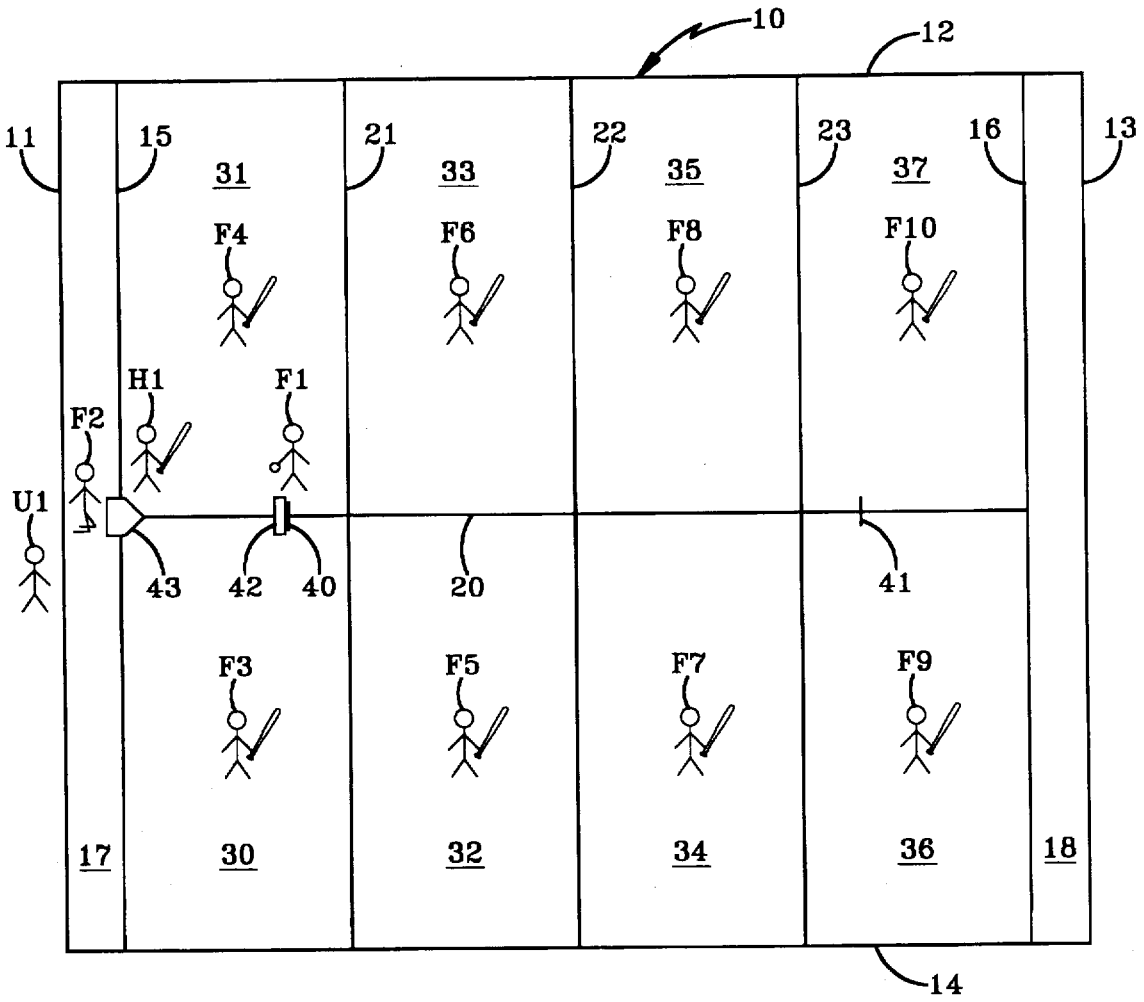
FIG. 4 is a plan view of the field with the players thereon for the start of the game.

Field 10 also includes a pair of pitching lines 40 and 41 which are parallel to base lines 21–23 and the goal lines 15 and 16. Specifically, field 10 includes pitching line 40 located between goal line 15 and base line 21, and pitching line 41 located between base line 23 and goal line 16. Pitching lines 40 and 41 indicate the location of a pitching rubber 42 as shown in FIG. 4 from which the pitcher pitches when a home plate 43 as described below is located on the goal lines 15 and 16, respectively.

The game is played by two teams of ten players including defensively a pitcher, a catcher, and eight fielders. The game is multiple innings long, preferably seven to nine innings in length. Each team both hits and defends once in each inning, that is, for one-half of the inning one of the two teams is on offense, i.e., primary hitting, while the other is on defense, i.e., secondary batting (or in alternative embodiments both hitting and fielding) depending upon the primary hitters location, and then the teams switch. Each half of an inning includes four hitters batting for the hitting team except a walked hitter does not count as a hitter and thus where walks occur more than four hitters may bat in a given half on an inning.

The general objective of each team is trying to score points by hitting the ball into the various zones in which points are awarded as described below, and this is done by meeting minor objectives such as advancing of home plate along the center line with each hit offensively and retreating of home plate along the center line with each subsequent hit defensively. Specifically, the major objective for the offensive team is to hit a baseball pitched to the player on the hitting team that is at bat which causes advancement of home plate or scoring of points when hit into the end zone. The major objective for the defensive team is to hit back any baseball hit into fair territory by the player at bat (or in an alternative embodiment, to catch any baseball hit by the player at bat into foul territory).

Specifically, the game starts with the home plate 43 on the goal line of the hitting team which is shown in FIG. 3 as goal line 15. A pitcher F1 for the defensive team is positioned on pitching rubber 42. A catcher F2 for the defensive team is positioned behind portable home plate 43 which is presently positioned on goal line 15. Eight fielders F3, F4, F5, F6, F7, F8, F9, and F10 for the defensive team are each positioned in one of the eight zones 30–37, respectively. At this point, all of the zones and thus all of the fielders are in fair play. Each of the fielders in fair play has a baseball bat for use if the hitter hits the pitched baseball into their zone.

As shown in FIG. 4 all of the various embodiments described below begin with, pitcher F1 pitching the baseball toward the catcher F2 and preferably at least near if not over home plate. A hitter H1 (the first player in the lineup for the offensive team) using a baseball bat attempts to hit the baseball when it is near or over home plate. If the hitter does not swing at the baseball, an umpire U1 makes a determination as to whether the pitch was either a strike (within an imaginary zone of a height dimension extending from approximately the hitter's arm pit to the hitter's knee and of a width dimension ascending upward from home plate at the same width as home plate), or a ball (outside of the imaginary zone).

If the hitter swings at the pitched baseball, the hitter will either miss the baseball, hit the baseball in foul or out-of-bounds territory, or hit the baseball into fair territory. If the hitter misses the baseball, the pitch is a strike. Each hitter is only allowed three strikes whereby the hitter is out. When the hitter strikes out, home plate does not move and the next hitter on the offensive team gets to hit from the same location.

Figure 5:
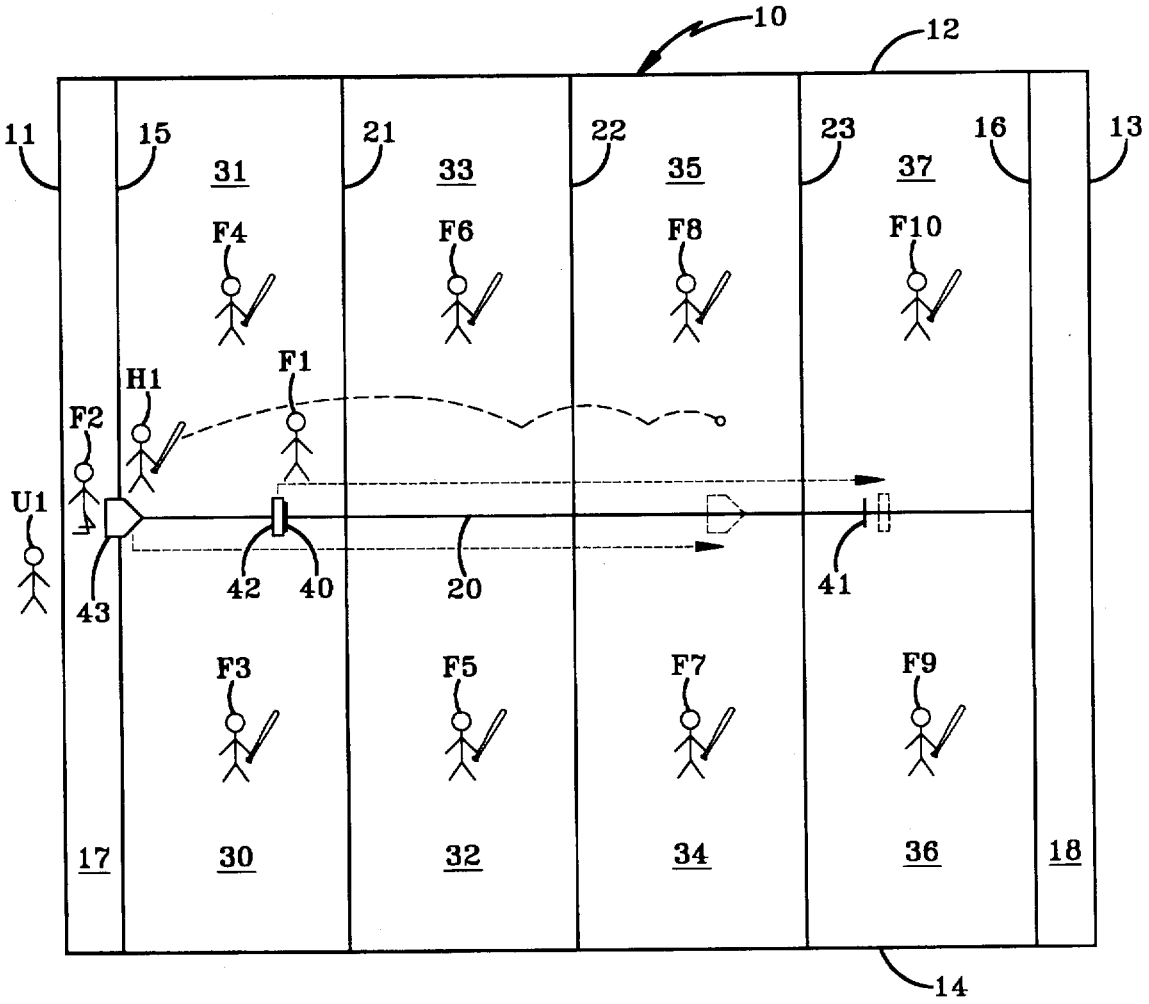
FIG. 5 is a plan view of the field where the hitter hit a non-home run that was not hit back by the fielding team.
Figure 6:
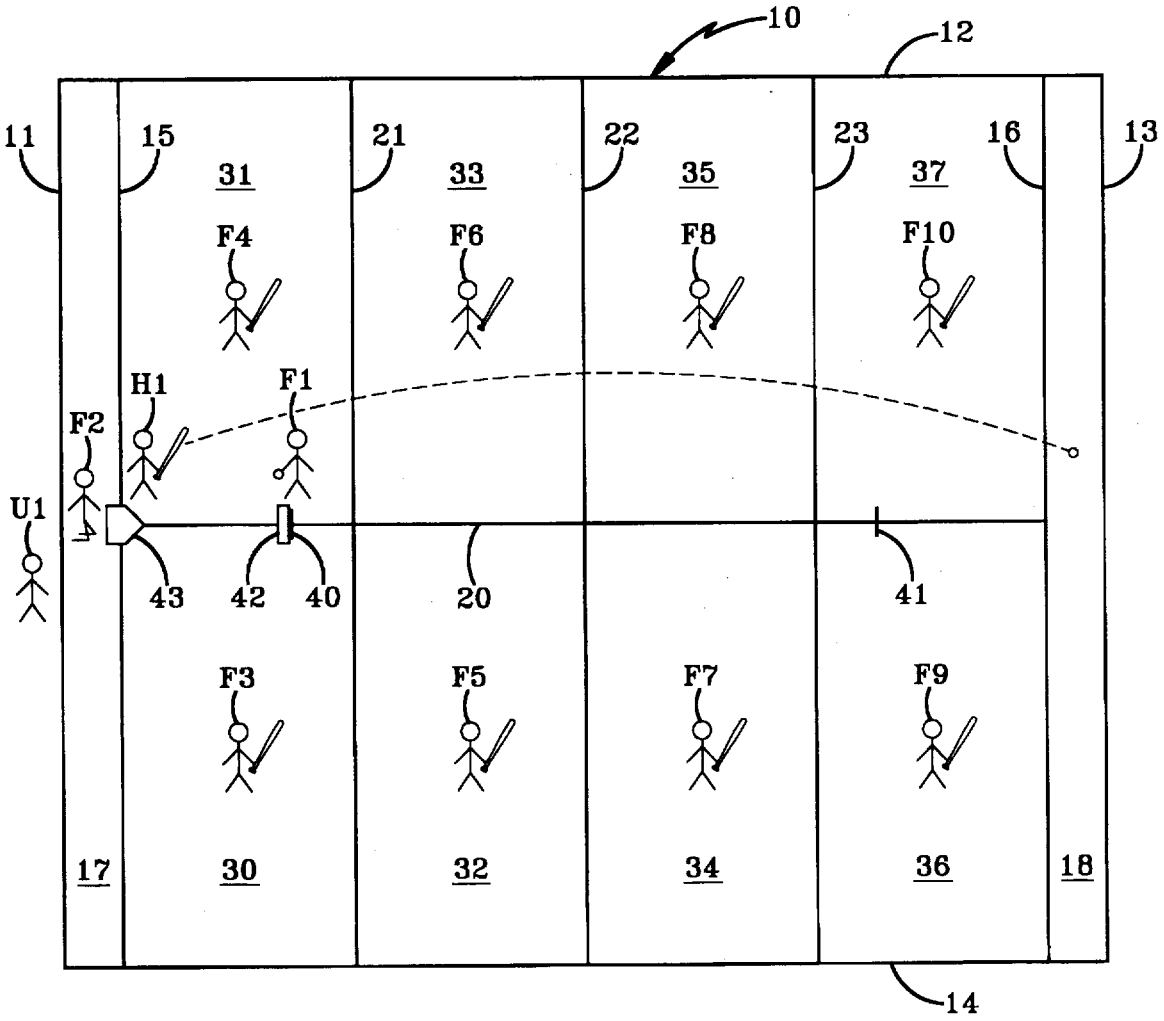
FIG. 6 is a plan view where the hitter hit a home run.
Figure 7:
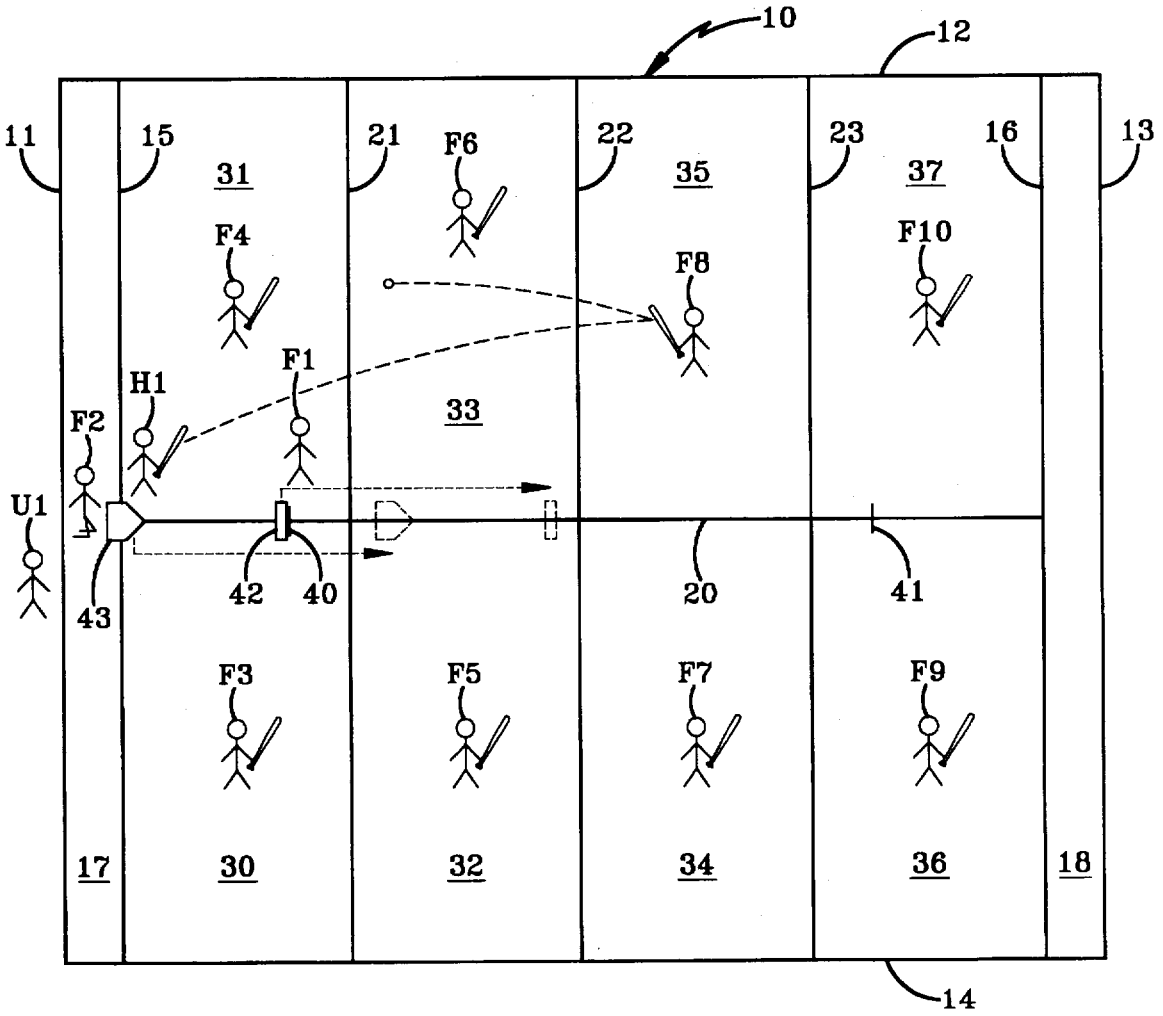
FIG. 7 is a plan view where the hitter hit a non-home run followed by the fielder hitting a non-home run.

If the hitter hits the baseball into fair territory, fielders F3–F10 using their bats may attempt to hit the moving baseball back towards the hitter H1 and preferably over the goal line 15 adjacent the hitter and into the end zone 17 behind the hitter. If the hitter hits the baseball and none of the fielders are able to hit the moving baseball, then home plate 43 is advanced along center line 20 to the position where the baseball stopped rolling at as shown in FIG. 5. If the ball crosses the goal line of the defensive team, in this case goal line 16, then the offensive team on which the hitter plays has scored points as explained in detail below and as shown in FIG. 6. In contrast, if the hitter hits the baseball and one of the fielders is able to hit the moving baseball, then home plate is advanced or pushed back along center line 20 to the position the baseball stopped rolling at as shown in FIG. 7. Only one fielder may hit the moving baseball per play. If the hit by the fielder crosses the goal line, in this case goal line 15, adjacent the hitter, then the defensive team on which the fielder plays has scored points as explained in detail below.

Figure 8:
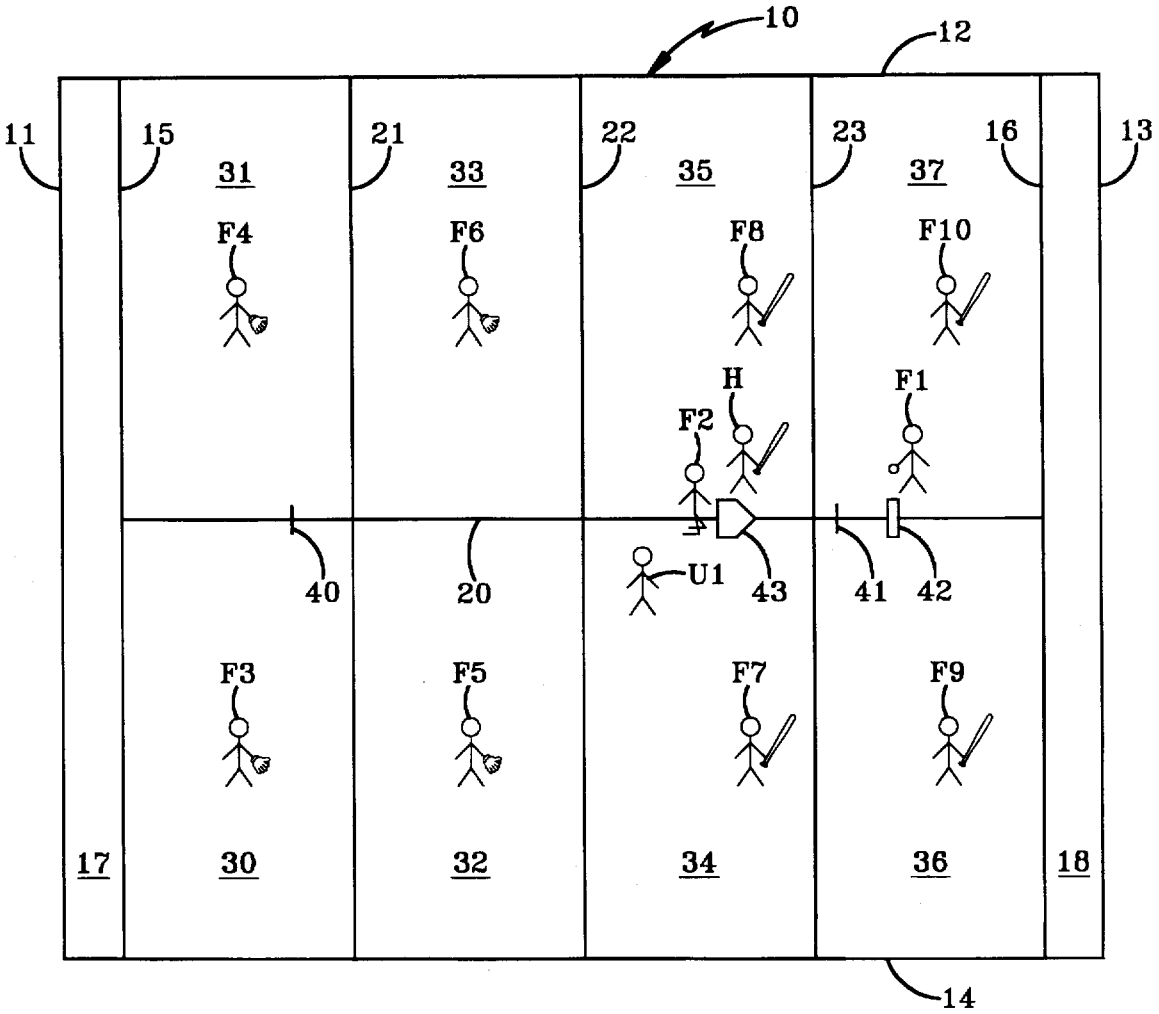
FIG. 8 is a plan view showing the advancement of home plate based upon the hit in FIG. 4.

Assuming the first hitter has hit the baseball, as shown in FIG. 5 for example, thereby advancing home plate along the center line 20 to a spot adjacent the baseball, the pitching rubber is advanced along the center line an equivalent distance such that the pitching rubber always remains the same distance from home plate as shown in FIG. 8. In the preferred embodiment this distance is sixty feet and six inches.

Various embodiments defining different methods and strategies of playing the game have been invented and will be described below as extensions of the game already begun in the proceeding paragraphs. In the preferred embodiment as is described in the immediate succeeding paragraphs, advancement of home plate away from the goal line results in removal of fielders by the defensive/secondary hitting team. In contrast, in an alternative embodiment as described later, advancement of home plate way from the goal line results in replacement of the bats held by the fielders behind and/or adjacent the advanced home plate with mitts held by those fielders.

In the preferred embodiment after the first hitter has hit the baseball as shown in FIG. 5. The pitcher then pitches to the next batter as shown in FIG. 8. However, the field and method of play is slightly different now that home plate is not on a goal line. Foul territory now exists in all complete zones behind home plate whereby all fielders in these zones are removed from the field. In the case as shown here where home plate 43 is between base lines, in this instance base lines 22 and 23, the fielders in the zones adjacent thereto, in this case F7 and F8, continue to use bats, although these fielders are often moved forward so as to be positioned in front of home plate. Alternatively, these fielders in zones adjacent home plate may be removed whereby the portion of their zone in front of home plate is either covered by an adjacent fielder or becomes foul territory.

Scoring is based upon hitting the ball either offensively or defensively over the opponent's goal line and into or through the opponent's end zone. In the preferred embodiment, the quantity of points scored is based upon the ball crossing the goal line, and (2) the number of teammates that hit in the same inning without walking. For example, if the first hitter on the offensive team hits the ball from home plate on his goal line into the opposing end zone, then the ball crossed the opposing team's goal line and is thus worth 4 points since there were no previous hitters.

A second example assumes the first hitter gets a hit and advances the ball to the first base line and the fielding team does not re-hit the moving ball. The second hitter then hits the ball from home plate on his first base line into the opposing end zone either on the fly or bounce, then the ball crossed said goal line and is thus worth three points because he was the second hitter (first hitter scores four points; second hitter scores three points, etc.).

In contrast, the fielding team scoring of points scored is based upon the number of base lines plus the goal line that the hit ball crossed after being hit by a fielder. For example, if the first hitter on the offensive team hits the ball from home plate on his goal line into the furthest defensive zone, namely zones 36 or 37 either on the fly or bounce and then the fielder re-hit the ball all the way back to goal line 15, then the ball crossed his first base line, second base line, third base line, and goal line and is thus worth four points to the defensive team.

A third example assumes the first hitter gets a hit and advances the ball to the first base line and the fielding team does not re-hit the moving ball. The second hitter then hits the ball from home plate on his first base line into the opposing end zone either on the fly or bounce, then the ball crossing the goal line is thus worth three points because he was the second hitter in the inning.

A fourth example assumes the first hitter gets a hit and advances the second hitter then strikes out. The third hitter hits a short fly ball that a fielder re-hits back behind the first base-line. The fourth hitter then hits the ball over the goal line. Only one point is scored for the hit because the fourth hitter was fourth in the inning to bat. If the second hitter had instead walked (which advances home plate) then this hitter would not have counted under the preferred embodiment and thus only three hitters would have come to bat when the ball was hit over the goal line resulting in two points instead of one.

Figure 9:
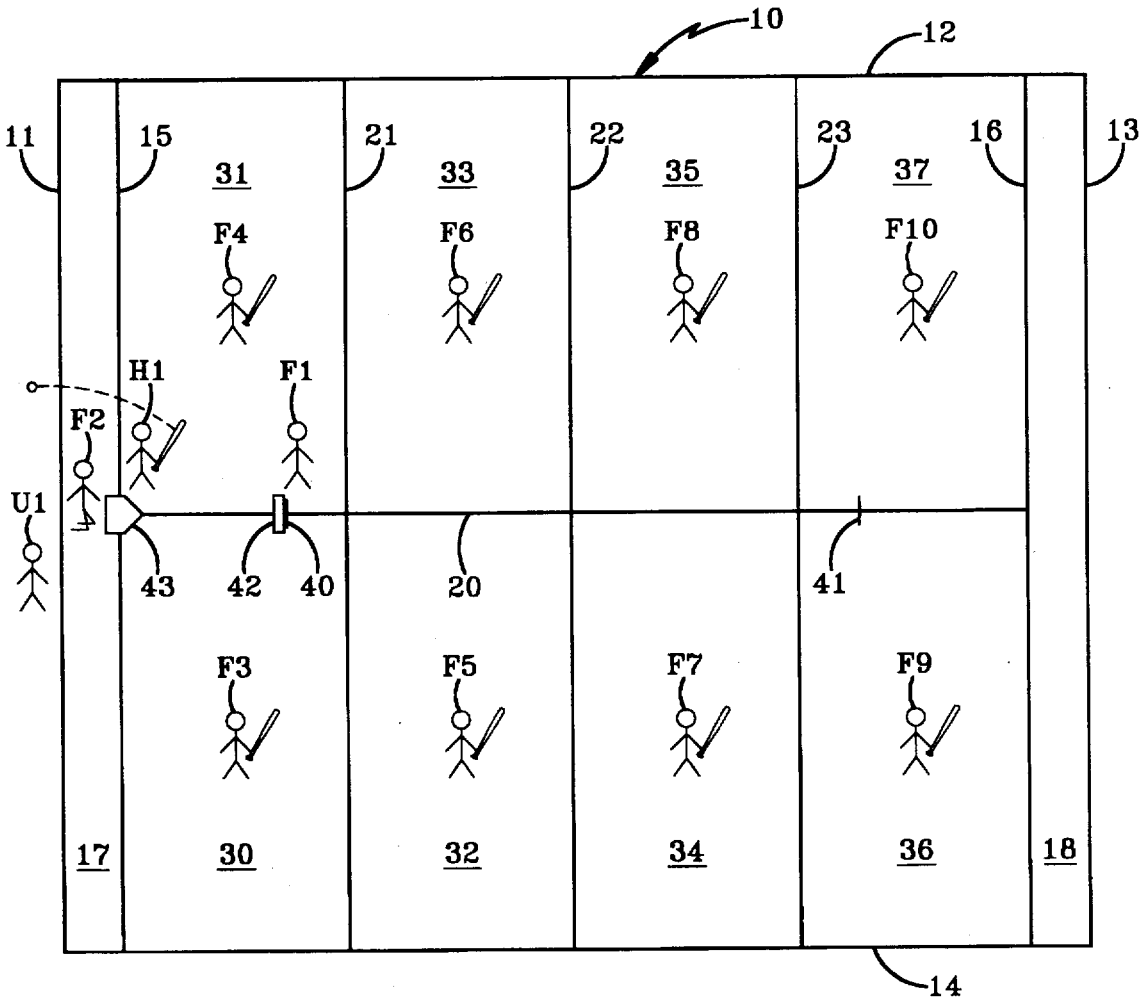
FIG. 9 is a plan view of a foul ball hit when home plate is on a goal line.

The following sequence is one sample illustrating one possible game sequence for one inning. The inning always starts with home plate on one of the goal lines, in this case goal line 15 as is shown in FIG. 9. First hitter H1 steps up to hit and pitcher F1 throws five baseballs toward the hitter who does not swing at any of the pitches. The umpire U1 calls two of the pitches strikes resulting in a count of three balls and two strikes. The hitter H1 hits a foul ball that the catcher F2 does not catch. This first hitter H1 is out because a foul ball is a strike resulting in a third strike which equates to an out. Home plate remain on the goal line 15.

Figure 10:
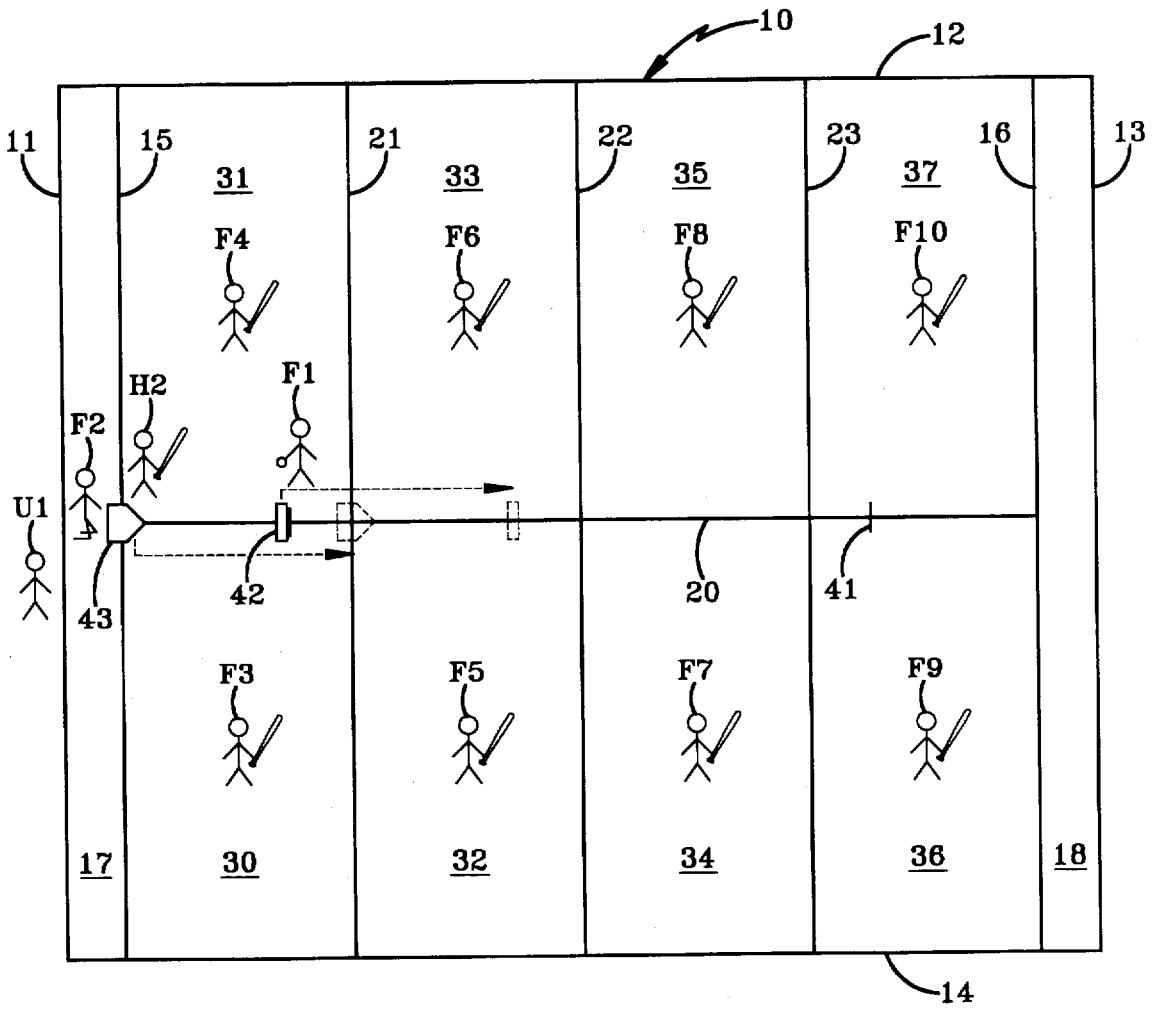
FIG. 10 is a plan view of home plate advancing one base for a walk.

The second hitter H2 does not swing at any of the first four pitches all of which are balls. This results in the second hitter H2 being walked. The result is that home plate 43 is advanced along center line 20 to the next base line as is shown in FIG. 10. The pitching rubber 42 is also advanced so that it remains equidistant from home plate. Zones 30 and 31 are now in foul territory and the fielders playing therein (fielders F3 and F4) leave the game.

Figure 11:
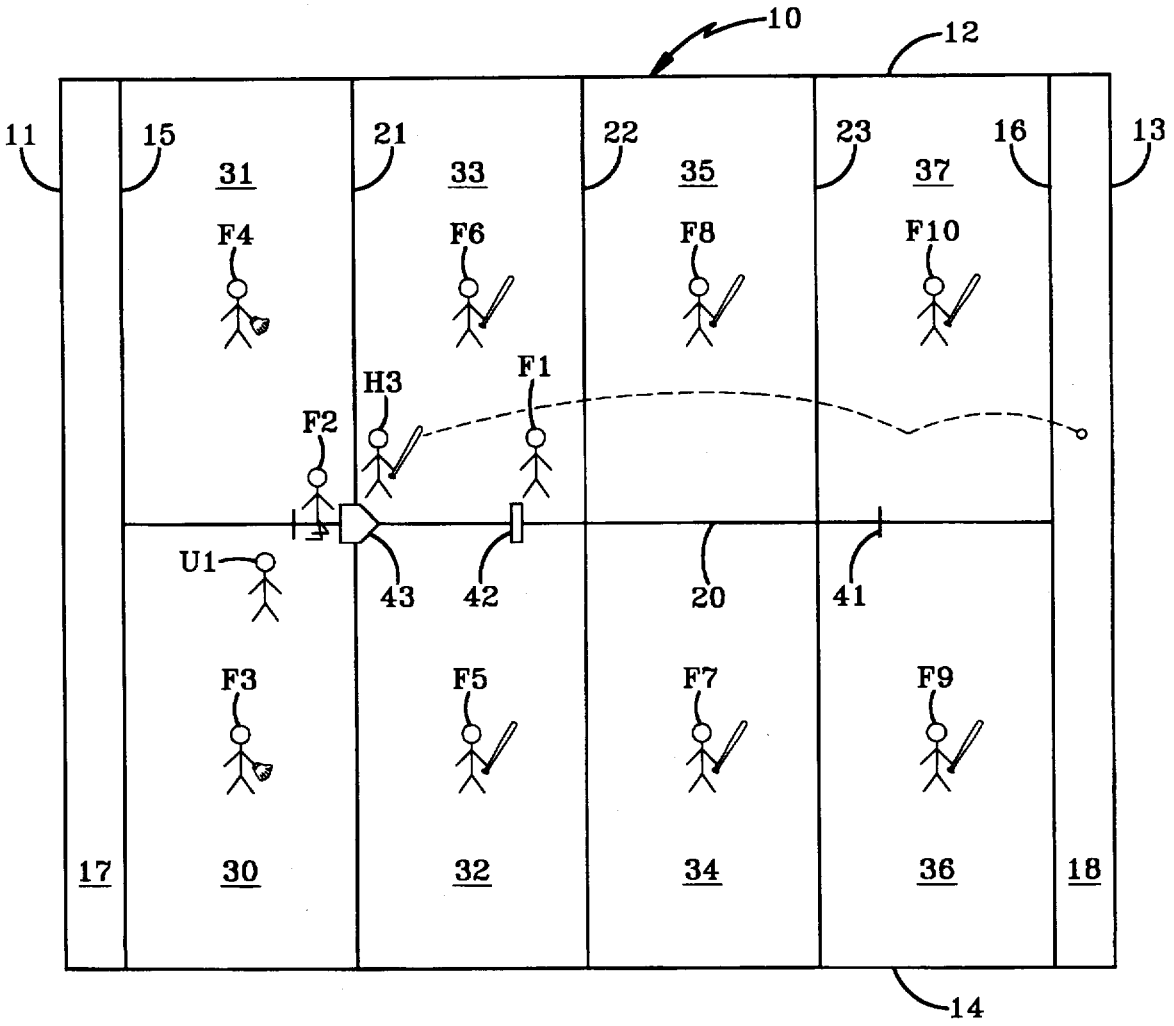
FIG. 11 is a plan view where the hitter hit a home run after home plate had previously advanced away from a goal line.

The third hitter H3 hits the first pitch as a long fly ball that lands in front of goal line 16 and skips over the goal line and into end zone 18 as is shown in FIG. 11 (alternatively, the long fly ball could land in the end zone for the same result). Hitter H3's team scores three points under standard scoring based upon his being the second hitter who did not walk.

Home plate is moved back to the other goal line, that is goal line 15, as is shown in FIG. 11 and originally shown in FIG. 6. The fourth hitter strikes out. The fifth hitter H5 hits the first pitch into the opposing end zone 18 as is shown in FIG. 6. This hit is a home run and scores 1 point (fourth batter who didn't walk).

The first half of the first inning is over because each half of an inning consists of four hitters who did not walk. Thus, in the above example, one hitter walked so five hitters came to bat.

Figure 12:
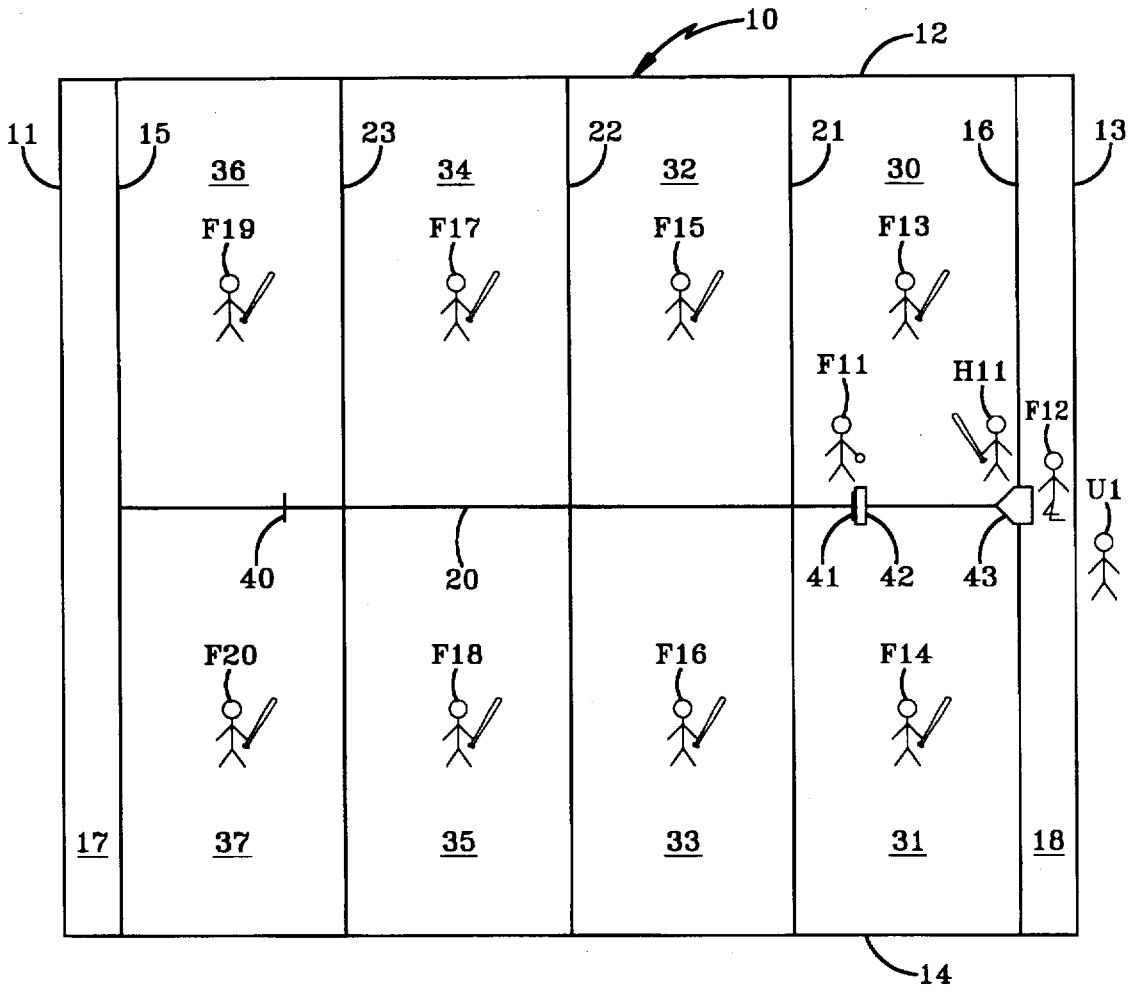
FIG. 12 is a plan view of the field after the players rotated from offense to defense and vice-versa after half of an inning was played.

The bottom half of the inning starts with each team changing sides, that is, the team that hit in the first half of the inning takes the field as a pitcher, a catcher, and eight fielders, while the team that played the field in the first half of the inning takes its turn hitting as is shown in FIG. 12. Specifically, the hitters H1–H5 (and H6–H10 who did not hit in this inning but are playing for the offensive team) take the field as fielders F11–F20, and fielders F1–F10 who played the field in the other half of the inning now hit as hitters H11–H20. In addition, home plate is moved to the opposite goal line to start this new half of an inning. Specifically, home plate is moved to goal line 16 and the pitching rubber is moved along the center line to pitching line 41. Finally, the first base and third base lines flip, that is lines 21 and 23 interchange as is shown from FIG. 4 to FIG. 12. Similarly, the location of the fields 30–37 interchange or flip.

Figure 13:
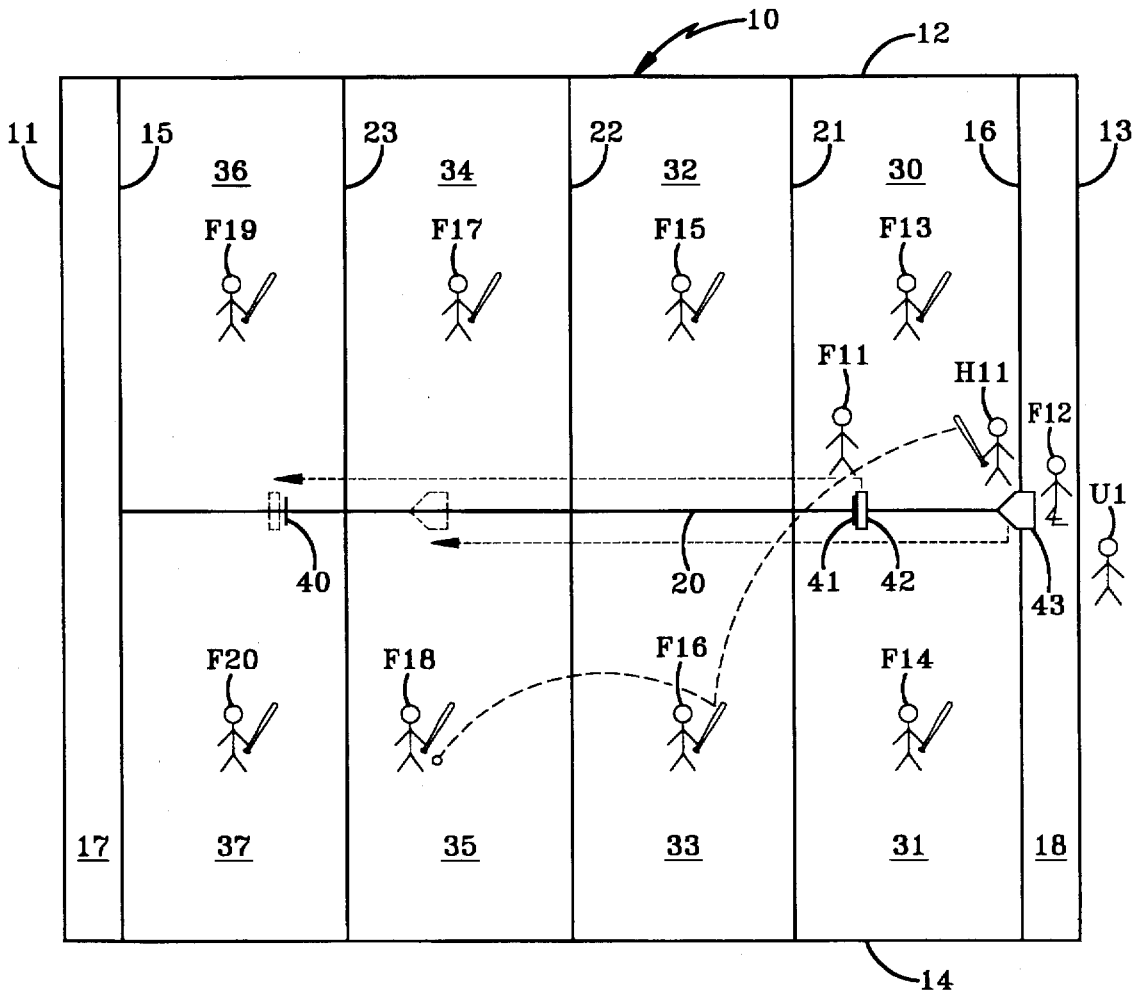
FIG. 13 is a plan view where the hitter hits a non-home run and the fielder fouls off the moving ball.

The sixth hitter H11 of the inning (also the first hitter of the bottom half of the inning) hits the ball over line 23 which is the new first base line into zone 33 where the second left fielder F16 is playing as is shown in FIG. 13. The second left fielder F16 fouls the ball off while it was still moving such that the ball passes over the second base line 22 to the third left field 35 where the ball stops. The third left fielder F18 could not hit the ball since only one defensive player is allowed to hit the ball. Home plate 43 is advanced along center line 20 all the way to the location in line with where the ball came to rest after the defensive player hit the ball.

Figure 14:
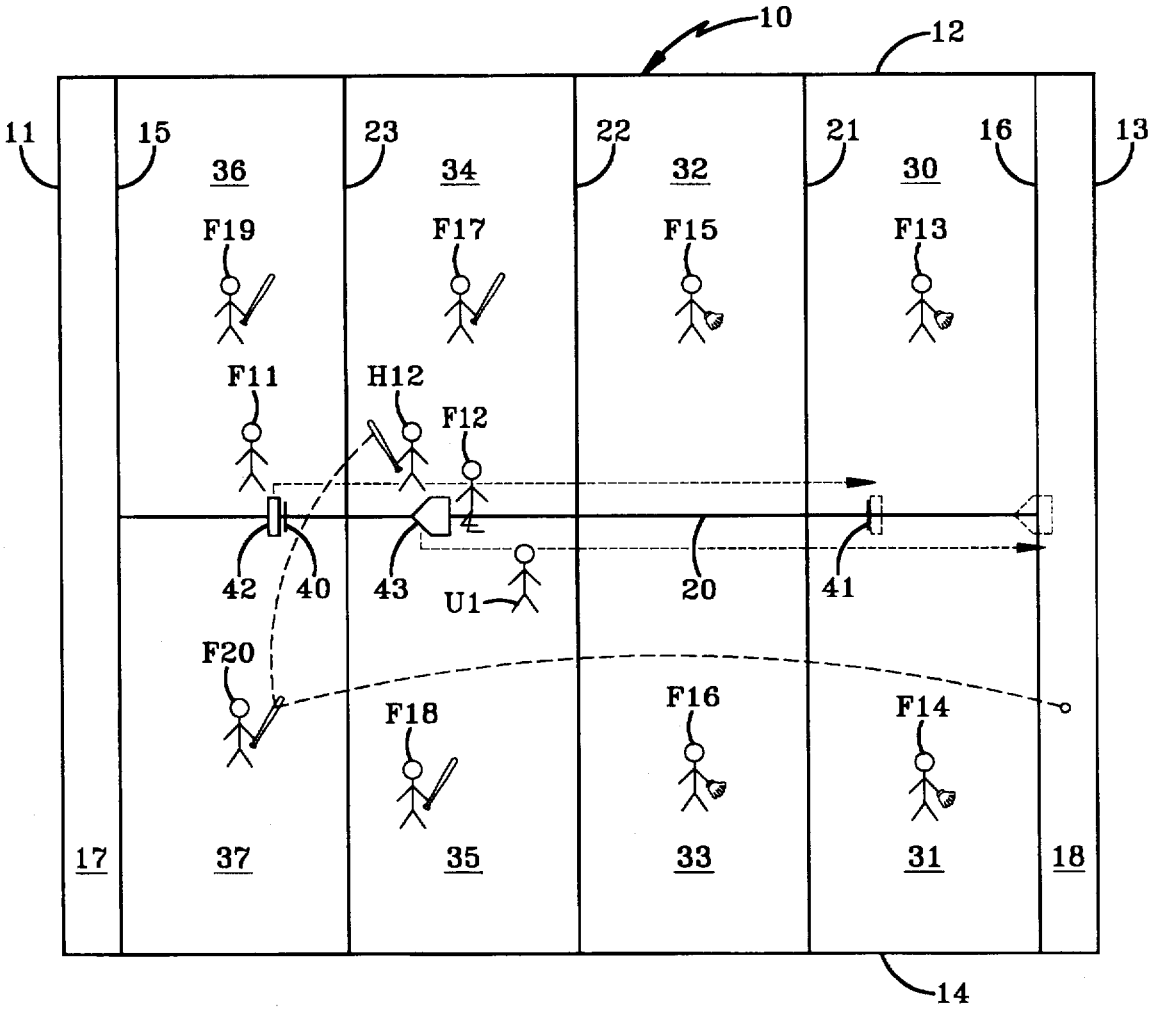
FIG. 14 is a plan view where the hitter hits a non-home run and the fielder hits a home run.

The second hitter H12 of the bottom half of the inning (which in this case is the seventh hitter in the inning) hits the first pitch to left fourth field as is shown in FIG. 14. The left fourth fielder F20 hits the moving ball back over the opposite goal line, that is over goal line 16. The defensive team then scores four points (because the ball defensively crossed four lines). The points scored are based upon the scoring systems used for the defensive team.

Home plate is then positioned on the goal line 16 and shown in FIG. 13 and the inning continues. The third hitter H13 of the bottom half of the inning (which in this case is the eighth hitter in the inning) takes a strike and a ball before hitting the ball into the field. Home plate is then advanced to the location where the ball stopped rolling.

The fourth hitter H14 of the bottom half of the inning (which is the ninth hitter in the inning) similarly gets a hit that advances the ball but not into the end zone. The inning is then over because the ninth hitter was the fourth batter of this half inning to not walk.

This sequence shows one possible sequence of one inning. Other sequences may alternatively taken on any number of different scenarios which are clearly contemplated under the above described rules and objectives.

In an alternative embodiment, again the first hitter has hit the baseball, as shown in FIG. 5 for example, thereby advancing home plate along the center line 20 to a spot adjacent the baseball, the pitching rubber is advanced along the center line an equivalent distance such that the pitching rubber always remains the same distance from home plate as shown in FIG. 8.

Figure 15:
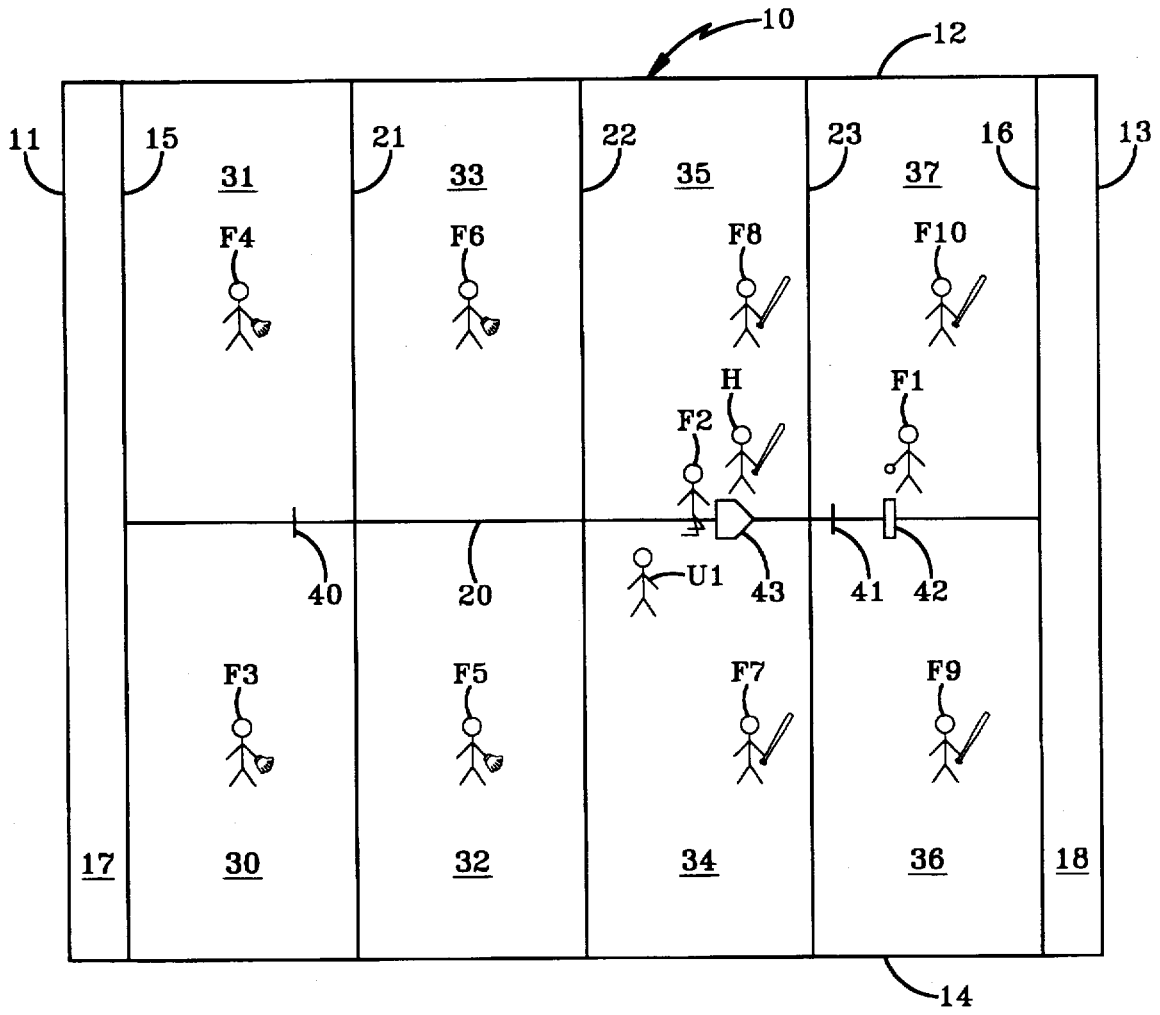
FIG. 15 is a plan view of a second embodiment sowing the advancement of home plate based upon the hit in FIG. 4.

The pitcher then pitches to the next batter. However, the field and method of play is slightly different now that home plate is not on a goal line. Foul territory now exists in all complete zones behind home plate and in this alternative embodiment, all fielders in these zones use gloves to catch the foul balls rather than attempt to hit the foul balls as is shown in FIG. 15. In the case as shown here where home plate 43 is between base lines, in this instance base lines 22 and 23, the fielders in the zones adjacent thereto, in this case F7 and F8, continue to use bats.

As is shown in FIG. 15 these adjacent zones are also foul and thus these adjacent fielders F7 and F8 use mitts instead of bats. Alternatively, instead of moving home plate along the center line to the location that the hit ball stopped rolling, home plate is moved to the nearest base line to where the ball stopped rolling thereby clearly defining which fielders have bats and which have mitts. In a slight variation, instead of moving home plate along the center line to the location that the hit ball stopped rolling, home plate is moved to the next base line beyond where the ball stopped rolling thereby also clearly defining which fielders have bats and which have mitts.

Figure 16:
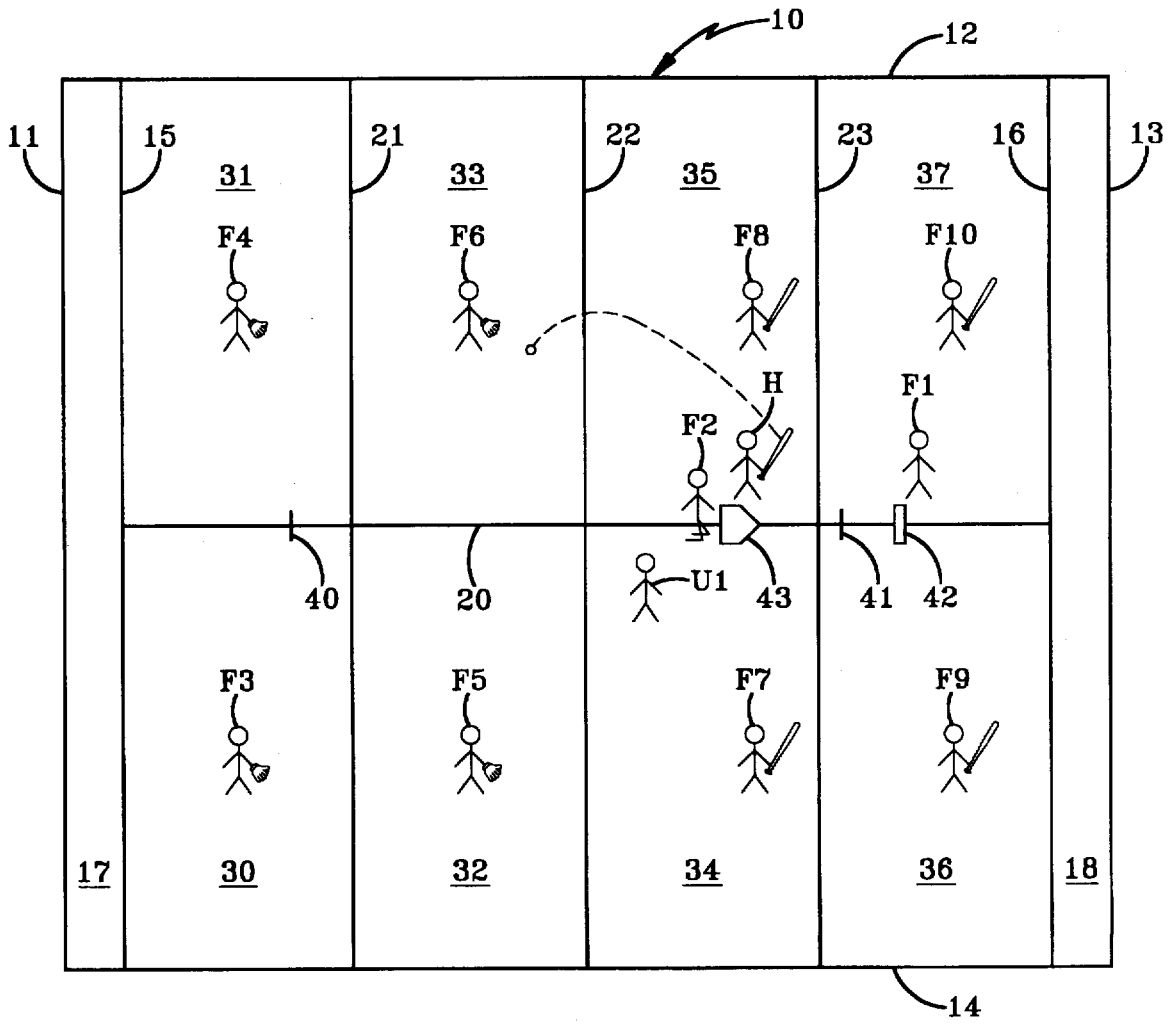
FIG. 16 is a plan view of a second embodiment of a foul ball hit after home plate had previously advanced away from a goal line.

In the case where the hitter hits the baseball into foul territory and a fielder does not catch the ball it is a strike, even if the hitter already has two strikes. In addition, where the hitter hits the baseball into foul territory and a fielder does catch the ball then the batter is out and home plate must be moved backwards so as to be adjacent the spot the foul ball was caught as is shown in FIG. 16, or alternatively to the respective base line as described in the preceding paragraph.

Scoring is based upon hitting the ball either offensively or defensively over the opponent's goal line and into or through the opponent's end zone. In the preferred embodiment, the quantity of points scored is based upon the ball crossing the goal line, and (2) the number of teammates that hit in the same inning without walking. For example, if the first hitter on the offensive team hits the ball from home plate on his goal line into the opposing end zone, then the ball crossed the opposing team's goal line and is thus worth one point only since there were no previous hitters.

A second example assumes the first hitter gets a hit and advances the ball to the first base line and the fielding team does not re-hit the moving ball. The second hitter then hits the ball from home plate on his first base line into the opposing end zone either on the fly or bounce, then the ball crossed said goal line and is thus worth two points (one for crossing the goal line and a second for being the second hitter of the inning to get a hit).

In another alternative scoring variation, the quantity of points scored is based upon both (1) the number of base lines plus the goal line that the hit ball crossed after being last hit, and (2) the number of teammates that hit in the same inning without walking. For example, if the first hitter on the offensive team hits the ball from home plate on his goal line into the opposing end zone either on the fly or bounce, then the ball crossed his first base line, second base line, third base line, and goal line and this was the first hitter so the hit is worth four points.

A second example assumes the first hitter gets a hit and advances the ball to the first base line and the fielding team does not re-hit the moving ball. The second hitter then hits the ball from home plate on his first base line into the opposing end zone either on the fly or bounce, then the ball crossed his second base line, third base line, and goal line and this is the second hitter of the inning so this hit is worth four points. Specifically, three points for the three line hit and one additional point for the hitter being the second hitter in the inning to hit the baseball into fair play.

The following sequence is one sample illustrating one possible game sequence for one inning using the alternative embodiment. The inning always starts with home plate on one of the goal lines, in this case goal line 15 as is shown in FIG. 9. First hitter H1 steps up to hit and pitcher F1 throws five baseballs toward the hitter who does not swing at any of the pitches. The umpire U1 calls two of the pitches strikes resulting in a count of three balls and two strikes. The hitter H1 hits a foul ball that the catcher F2 does not catch. There are no fielders behind the catcher to catch the foul ball since home plate is on a goal line. This first hitter H1 is out because a foul ball is a strike resulting in a third strike which equates to an out. Home plate remain on the goal line 15.

The second hitter H2 does not swing at any of the first four pitches all of which are balls. The result is that home plate 43 is advanced along center line 20 to the next base line as shown in FIG. 10. The pitching rubber 42 is also advanced so that it remains equidistant from home plate. Zones 30 and 31 are now in foul territory and the fielders playing therein (fielders F3 and F4) use baseball gloves or mitts rather than bats.

Figure 17:
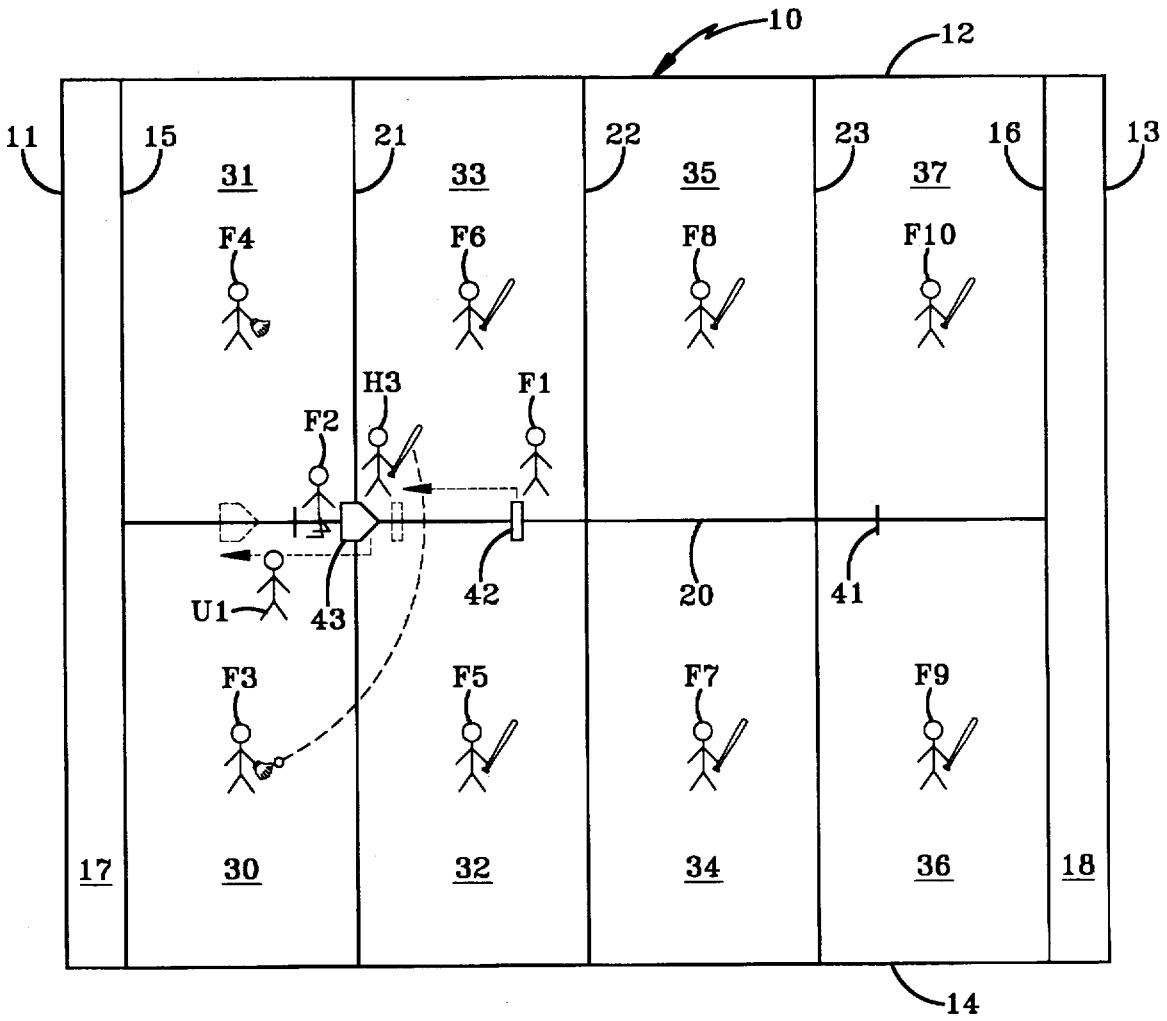
FIG. 17 is a plan view of a second embodiment of a foul ball hit after home plate had previously advanced away from a goal line where a fielder catches the foul ball.

On the first pitch, the third hitter H3 hits a foul ball which is caught by the right first fielder F3 playing in zone 30 as is shown in FIG. 17. The third hitter H3 is out and home plate 43 must retreat backwards along the center line to the point on the center line adjacent the spot the foul ball was caught. Similarly, the pitching rubber 42 is moved along with home plate 43 so as to maintain the constant distance between the pitching rubber and home plate.

Figure 18:
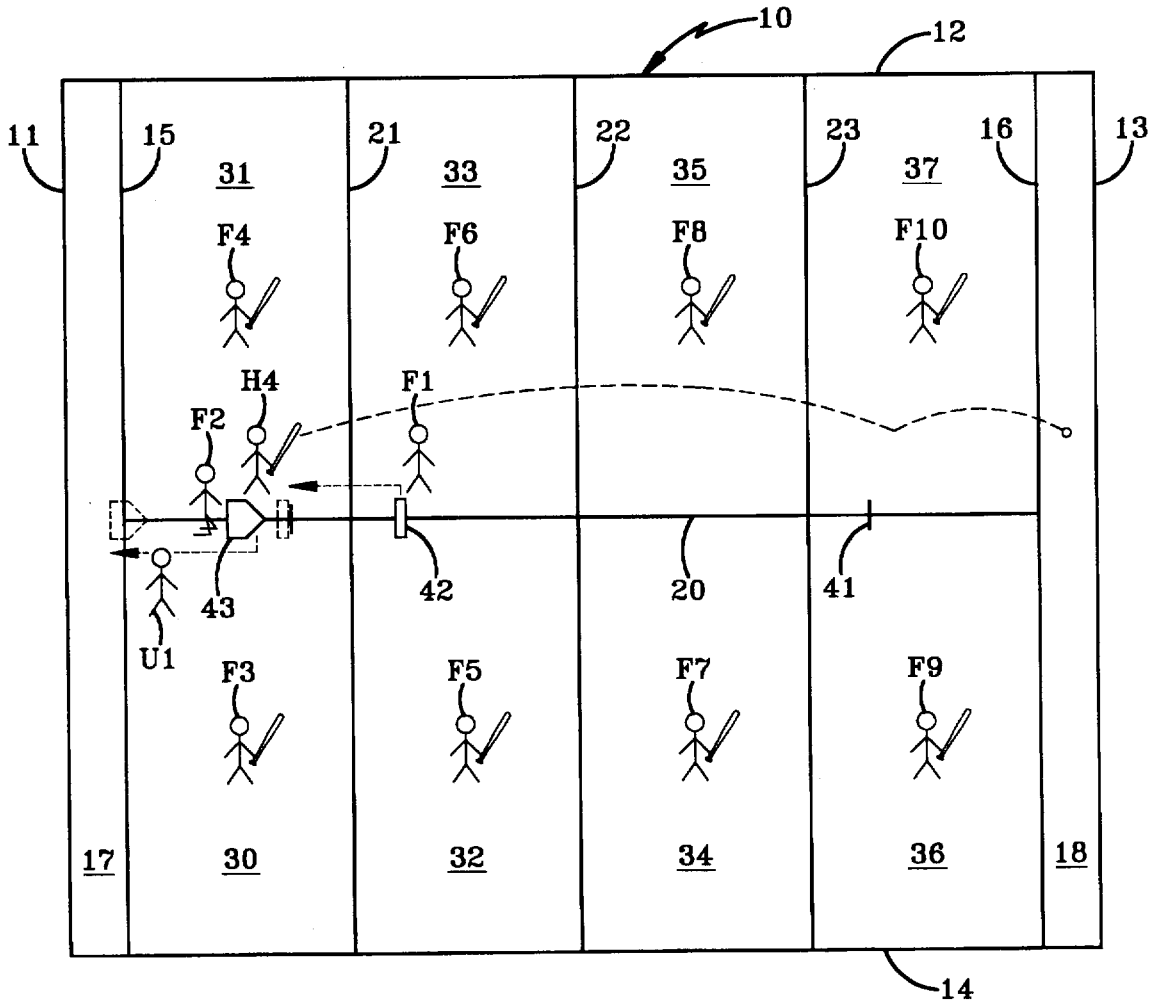
FIG. 18 is plan view of a second embodiment where the hitter hit a home run after home plate had previously advanced away from a goal line.

The fourth hitter H4 hits the first pitch as a long fly ball that lands in front of goal line 16 and skips over the goal line and into end zone 18 as is shown in FIG. 18 (alternatively, the long fly ball could land in the end zone for the same result). Hitter H4's team scores three points under standard scoring based upon one point for crossing the defensive team's goal line, and two points for the previous two hitters in the inning that hit the baseball. Alternatively, under the first alternative scoring system, hitter H4's team scores six (6) points for his team because the ball crossed the goal line (four points for crossing first, second, third and the goal line) and more points because he was the third hitter in the inning who did not walk (two more points). Alternatively, under the second alternative scoring system, only four points are scored if the other point system is used that ignores number of hitters hitting per inning.

Home plate is moved back to the other goal line, that is goal line 15, as is shown in FIG. 18. The fifth hitter H5 hits the first pitch deep into the stands behind the opposing end zone 18 as is shown in FIG. 6. This hit is a home run.

The first half of the first inning is over because each half of an inning consists of four hitters who did not walk. Thus, in the above example, one hitter walked so five hitters came to bat.

The bottom half of the inning starts with each team changing sides, that is, the team that hit in the first half of the inning takes the field as a pitcher, a catcher, and eight fielders, while the team that played the field in the first half of the inning takes its turn hitting as is shown in FIG. 12. Specifically, the hitters H1–H5 (and H6–H10 who did not hit in this inning but are playing for the offensive team) take the field as fielders F11–F20, and fielders F1–F10 who played the field in the other half of the inning now hit as hitters H11–H20. In addition, home plate is moved to the opposite goal line to start this new half of an inning. Specifically, home plate is moved to goal line 16 and the pitching rubber is moved along the center line to pitching line 41. Finally, the first base and third base lines flip, that is lines 21 and 23 interchange. Similarly, the location of the fields 30–37 interchange or flip.

The sixth hitter H11 of the inning (also the first hitter of the bottom half of the inning) hits the ball over line 23 which is the new first base line into zone 33 where the second left fielder F16 is playing as is shown in FIG. 13. The second left fielder F16 fouls the ball off while it was still moving such that the ball passes over the second base line 22 to the third left field 35 where the ball stops. The third left fielder F18 could not hit the ball since only one defensive player is allowed to hit the ball. Home plate 43 is advanced along center line 20 all the way to the location where the ball came to rest after the defensive player hit the ball.

Figure 19:
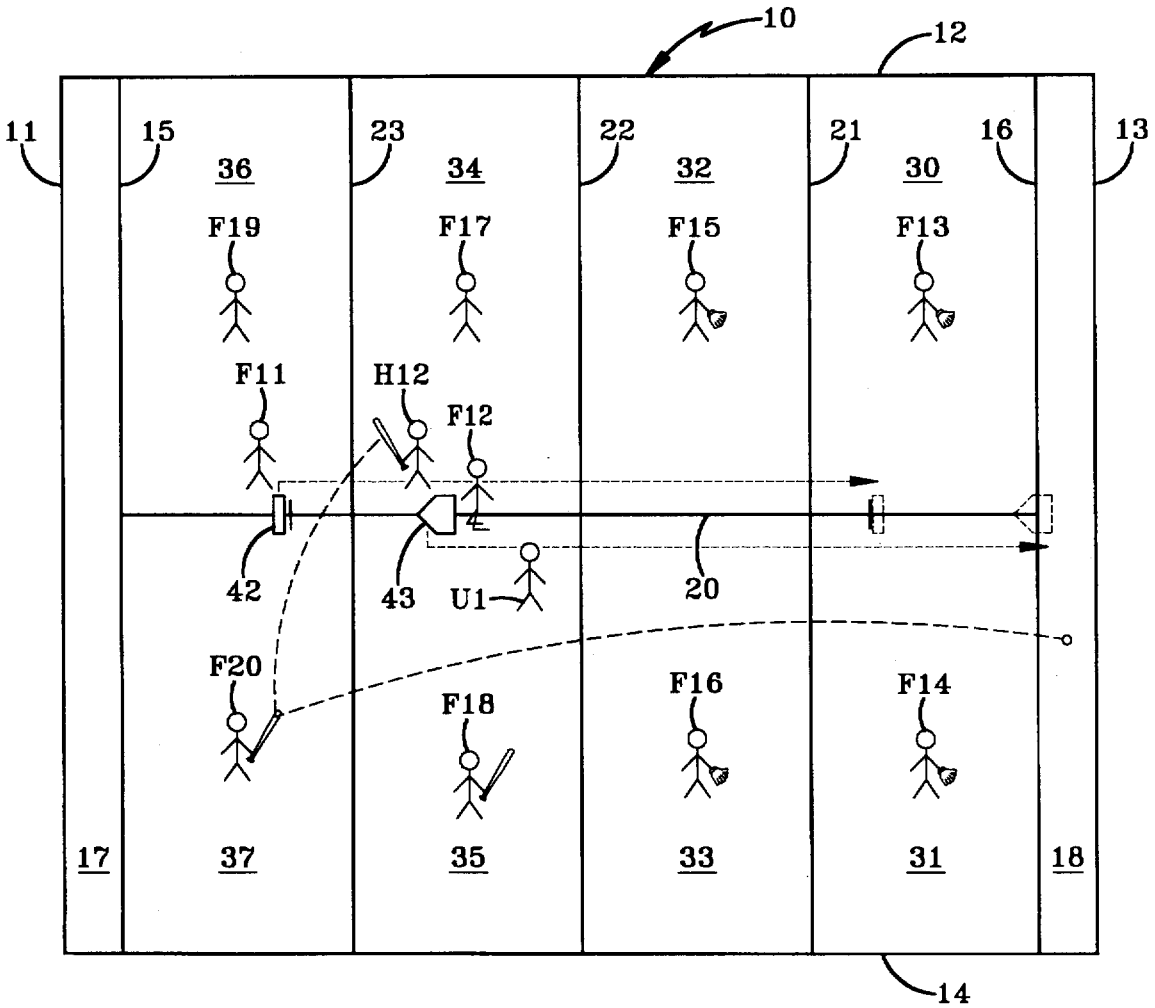
FIG. 19 is a plan view of a second embodiment where the hitter hits a non-home run and the fielder hits a home run.

The seventh hitter H12 hits the first pitch to left fourth field as is shown in FIG. 19. The left fourth fielder F20 hits the moving ball back over the opposite goal line, that is over goal line 16. The defensive team then scores points. The points scored are based upon the scoring systems used for the defensive team. Simple scoring gives the defensive team one point for the home run. More complex scoring gives the defensive team the same number of points the offensive team would have scored had the offensive team hit the home run from the point of the pitch (including points for previous hitters in the inning if that type of scoring is used).

Home plate is then positioned on the goal line 16 and shown in FIG. 12 and the inning continues. The eighth hitter H13 takes a strike and a ball before hitting the ball into the field. Home plate is then advanced to the location where the ball stopped rolling.

The ninth hitter H14 similarly gets a hit that advances the ball but not into the end zone. The inning is then over because the ninth hitter was the fourth batter of this half inning to not walk.

This sequence shows one possible sequence of one inning under the alternative embodiment. Other sequences may alternatively taken on any number of different scenarios which are clearly contemplated under the above described rules and objectives.

Accordingly, the improved bat and ball game is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved bat and ball game is constructed and used, the characteristics of the construction, and the advantageous, new and useful results obtained; the new and useful structures, devices, elements, arrangements, parts and combinations, are set forth in the appended claims.

I claim:

1. A method of playing a game using at least one bat, and at least one ball, on a rectangular field, the method comprising:

defining a playing surface as a rectangular-shaped field having a pair of opposing end lines separated by a pair of opposing side lines defining the field therebetween, the field further including a goal line parallel to and spaced apart from each of the end lines thereby defining an end zone between each goal line and end line, the field further including a plurality of zones as defined by a plurality of base lines parallel to and spaced apart between the goal lines and a center line parallel to and spaced apart between the side lines;

pitching a baseball from a pitching rubber positioned along the center line toward a plate spaced apart a constant distance from the pitching rubber along the center line; and selectively swinging at the baseball when in the proximity of the plate by a hitter adjacent the plate.

2. The method of playing a game of claim 1 wherein the step of selectively swinging further comprises:

a first hitting of the baseball.

3. The method of playing a game of claim 2 wherein the step of selectively swinging further comprises:

a first hitting of the baseball onto the field into at least one of the zones, where each of the zones includes a fielder; and swinging at the baseball by a fielder when the baseball enters the zone of that player.

4. The method of playing a game of claim 3 wherein the step of swinging further comprises:

subsequently hitting the baseball a second time prior to the baseball coming to a stop from the first hitting.

5. The method of playing a game of claim 2 subsequently including the steps of:

moving the plate along the center line to a point adjacent the baseball when the baseball comes to a stop after being hit; and defining a foul and a fair territory by a foul line parallel to and spaced apart from the goal lines where the plate is positioned along the center line at the intersection of the center and foul lines, where the fair territory includes the zones between the goal line and foul line on a side of the foul line that the plate is positioned while the foul territory includes the zones between the goal line and foul line on a side of the foul line opposite where the plate is positioned.

6. The method of playing a game of claim 5 subsequently including the steps of:

pitching a baseball from the pitching rubber positioned along the center line toward the plate spaced apart a constant distance from the pitching rubber along the center line; and selectively swinging at the baseball when in the proximity of the plate by another hitter adjacent the plate.

7. The method of playing a game of claim 6 wherein the step of swinging further comprises:

a further subsequent hitting of the baseball.

8. The method of playing a game of claim 6 wherein the step of swinging further comprises:

a further subsequent hitting of the baseball onto the field into at least one of the zones in fair territory; and swinging at the baseball by a fielder when the baseball enters the zone of that player.

9. The method of playing a game of claim 6 wherein the step of swinging may further comprise:

hitting the baseball onto the field into at least one of the zones in foul territory; and selectively catching the baseball by a fielder using a mitt when the baseball enters the zone of that player.

10. A game played on a field, the game apparatus comprising:

a rectangular-shaped field having at least one out of bounds line defining the field therein wherein the out of bounds line includes a pair of opposing end lines separated by a pair of opposing side lines defining the field therebetween, the field further including a center line dividing the field into two parts;

a goal line parallel to and spaced apart from each of the end lines thereby defining an end zone between each goal line and end line;

a plurality of zones as defined by a plurality of base lines parallel to and spaced apart between the goal lines and where the center line is parallel to and spaced apart between the side lines;

a portable pitching rubber moveable along the center line on the field; and a portable plate moveable along the center line and spaced apart a constant distance from the portable pitching rubber.

* * * * *

UNITED STATES PATENT AND TRADEMARK OFFICE

CERTIFICATE OF CORRECTION

PATENT NO. : 5,722,907

DATED : March 3, 1998

INVENTOR(S) : C. L. Paulun

It is certified that error appears in the above-identified patent and that said Letters Patent is hereby corrected as shown below:

In the Abstract, first line, the wording "novel athletic filed" should read -- novel athletic field--.

At column 3, line 45 the wording "FIG. 4" should read —FIG. 5--.

At column 3, line 60 the wording "sowing" should read --showing--.

At column 3, line 61 the wording "FIG. 4" should read —FIG. 5--.

At column 5, line 2 the wording "half on" should read --half of--.

At column 6, line 20, the wording"way from the goal" should read --away from the goal--.

At column 8, line 35, the wording"may alternatively taken on" should read --may alternatively take on —.

Signed and Sealed this

Twenty-third Day of June, 1998

Bruce Lehman

*Attest:*

BRUCE LEHMAN

*Attesting Officer*

*Commissioner of Patents and Trademarks*